US005709238A

United States Patent [19]

Mattioli

[11] Patent Number: 5,709,238

[45] Date of Patent: Jan. 20, 1998

[54] TENT-FRAME CONSTRUCTION

[76] Inventor: Anthony Mattioli, 3501 Vestal Pkwy. East, Vestal, N.Y. 13850

[21] Appl. No.: 619,056

[22] Filed: Mar. 20, 1996

[51] Int. Cl.[6] ..... A45F 3/00; E04H 15/34

[52] U.S. Cl. ..... 135/87; 135/122; 135/114; 135/120.3; 135/158; 135/117

[58] Field of Search ..... 135/117, 114, 135/122, 120.3, 120.1, 156, 157, 158, 87

[56] References Cited

U.S. PATENT DOCUMENTS

| | | | |
|---|---|---|---|
| 2,488,809 | 11/1949 | Denn | 135/158 |
| 3,424,178 | 1/1969 | Yazaki | 135/120.3 X |
| 4,077,418 | 3/1978 | Cohen | 135/157 X |
| 4,558,713 | 12/1985 | Hagler et al. | 135/120.3 X |
| 4,607,656 | 8/1986 | Carter | 135/122 X |
| 5,224,507 | 7/1993 | Vosse | 135/115 X |
| 5,564,234 | 10/1996 | Vermeulen | 135/115 X |
| 5,584,311 | 12/1996 | Schaefer | 135/120.3 X |

FOREIGN PATENT DOCUMENTS

| | | | |
|---|---|---|---|
| 29653 | 10/1913 | United Kingdom | 135/122 |
| 814825 | 6/1959 | United Kingdom | 135/122 |

*Primary Examiner*—Wynn E. Wood
*Attorney, Agent, or Firm*—Salzman & Levy

[57] ABSTRACT

The present invention features a tent roof construction having a double, hollow, tubular joint. Vertical and side tubes that make up the tent-frame attach to this tubular joint. The improvement allows the tent-frame to be built quickly and without nuts and bolts (thus, allowing assembly and disassembly without tools) by using a second horizontal support tube, a tube which parallels the horizontal support tube of previous roof constructions. This second tube is located directly below the first horizontal support tube, thus allowing the canvas roof cover to be pulled over the first horizontal support tube and attached to the second horizontal support tube. Thus, the roof cover extends over the end of the roof frame and down the sides of the tent. The side covers extend up the inside of the tent-frame and attach to the first horizontal support tube, creating an overlap between the roof and side covers. Water running off the roof cover will now flow down the outside of the side covers, without ever entering the interior of the tent. In this manner, an effective water seal is achieved.

8 Claims, 5 Drawing Sheets

TENT-FRAME CONSTRUCTION

FIELD OF THE INVENTION

The present invention pertains to a quickly fabricated and rapidly dismantled canvas tent, which has coverings that are stretched and formed about a slide-together tubular frame, and, more particularly, to a canvas tent construction that has a double-tubular support, which provides a means for extending and securing the canvas cover over the end of the tent's roof and down its sides, in order to make the tent more water-resistant.

BACKGROUND OF THE INVENTION

Quickly fabricated and dismantled tent structures can be constructed from slide-together tubular frame supports, as illustrated in U.S. Pat. No. 3,424,178 (issued on Jan. 28, 1969, to Yoshimi Yazaki), entitled "Small Size Constructions which are Readily Fabricated or Dismantled".

Because of their lightweight construction and ease of use, slide-together tubular frames are very popular. The frame shown in the aforementioned patent, however, requires that the roof canvas be secured to the tubular frame by tie-strings that are threaded through eyelets in the canvas cover.

The present inventor has noticed that, no matter how tightly the canvas cover is stretched over the roof frame and tied to the horizontal tubes of the roof end section, there exist small openings at the juncture between the canvas cover and the frame, where rain can enter. Normal rains produce intrusive leakage by run-off, which can usually be tolerated without too much inconvenience. However, when rains are accompanied by moderate or high winds, or when the rains themselves are strong and steady, there is substantial and annoying leakage within the tent structure. In such rain-soaking situations, there is often enough leakage to even soak materials inside the tent, as if there were no covering whatsoever.

The present invention features a double-tubular joint that provides for the fabrication of a watertight tent. The double joint allows for a tent structure having two horizontal, parallel tubes extending from the vertical, tubular, side support shafts. The dressing of the tubular tent frame can now be accomplished in a different manner than that previously achieved. Instead of attaching the canvas cover to the horizontal tube at the end of the roof frame, the cover is now pulled over the horizontal tube at the end of the roof frame and tied to a second, parallel tube disposed directly below the first roof frame end tube. Due to the double-joint extension, the second horizontal tube can now be included in the frame. The resulting structure now allows for the roof frame to be completely covered. There are now no holes through which leakage can occur. Water run-off from the roof cover will now flow down the tent sides, thus leaving the contents inside the tent completely dry. Dressing the sides of the tent can be accomplished by attaching the side covers to the first horizontal tubular member. The side covers are extended upwards from inside the tubular frame, allowing for overlap with the roof canvas cover, effectively sealing the tent from the weather.

It is an object of this invention to provide an improved tent construction.

It is another object of this invention to provide a double joint for a tent-frame, whereby a second horizontal tube can be disposed below the horizontal end tube of the roof, allowing the roof canvas to be pulled thereover and attached to the second horizontal tube.

It is a further object of this invention to provide a tent construction that will provide an improved water seal.

It is yet another object of the present invention to provide a structure that can be assembled and disassembled in a matter of seconds, due to the fact that no nuts or bolts are required.

SUMMARY OF THE INVENTION

In accordance with the present invention, there is provided a tent roof construction featuring a double, hollow, tubular joint. Vertical and side tubes that make up the tent-frame attach to the tubular joint in a fashion that is similar to that shown in the aforementioned, prior art (U.S. Pat. No. 3,424,178). The improvement expressed by this invention, however, features its double joint, which allows the tent-frame to be built by using a second horizontal support tube, a tube which parallels the horizontal support tube of previous roof constructions. This second tube is disposed directly below the first horizontal support tube, thus allowing the canvas roof cover to be pulled over the first horizontal support tube and attached to the second horizontal support tube. Thus, the roof cover extends over the end of the roof frame and down the sides of the tent. The side covers extend up the sides of the tent-frame and attach to the first horizontal support tube, creating an overlap between the roof and side covers. Water running off the roof cover will now flow down the outside of the side covers, without ever entering the interior of the tent. In this manner, an effective water seal is achieved.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same designations throughout the FIGURES.

DESCRIPTION OF THE PREFERRED EMBODIMENT

Generally speaking, the invention features a new, double, hollow, tubular joint affording a new tent-frame construction. This double joint allows the tent-frame to be built with a second horizontal tube disposed below the end roof tube. Both horizontal and vertical tent-frame supports attach in a fashion such as that taught in U.S. Pat. No. 3,424,178. The roof canvas cover is now pulled over the end roof tube, and is attached to the new, second, horizontal support tube. The result is a watertight, quickly assemblable roof construction that does not require tools for assembly or disassembly.

Figure 1:
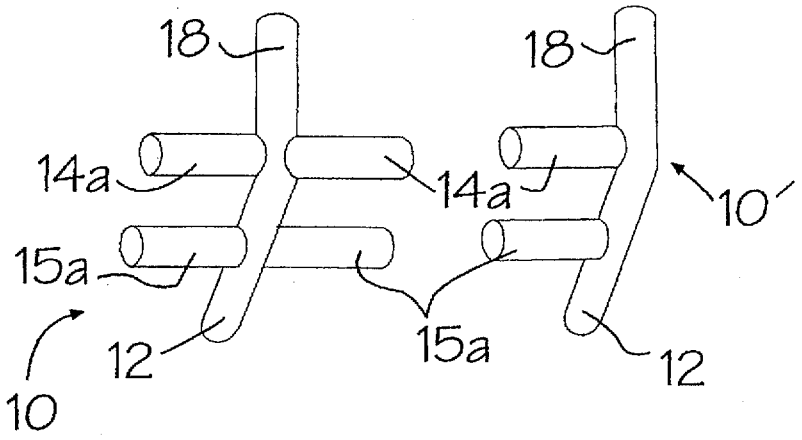
FIG. 1 illustrates a perspective view of the tent's middle and end supporting joints, using the double-tubular joint of this invention.
Figure 1A:
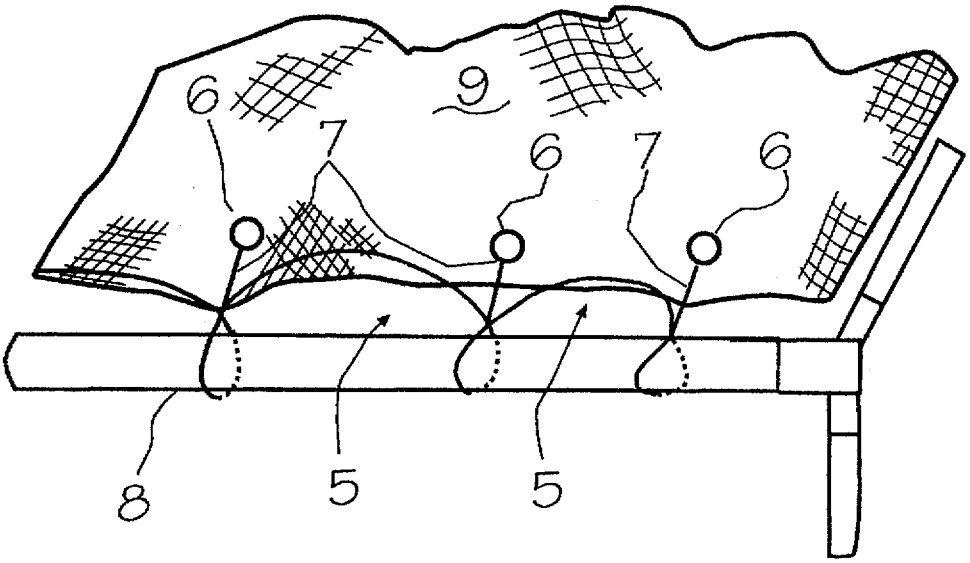
Figure 1a (Prior Art)
FIG. 1*a* shows a perspective view of a portion of a tent-frame of the prior art, one having openings in the roof cover to allow for water leakage.

Now referring to FIG. 1*a*, a partial view of a roof canvas cover 9 of prior art is shown in situ, with a roof horizontal end support tube 8. The canvas cover 9 is tied by strings 7 to the horizontal support tube 8 by means of eyelets 6, which are periodically disposed along the peripheral edge of the canvas cover 9. Spaces 5 are formed between the attachment points of the tube 8 and the eyelets 6. Water running off the cover 9 will leak into the interior of the tent.

Figure 2:
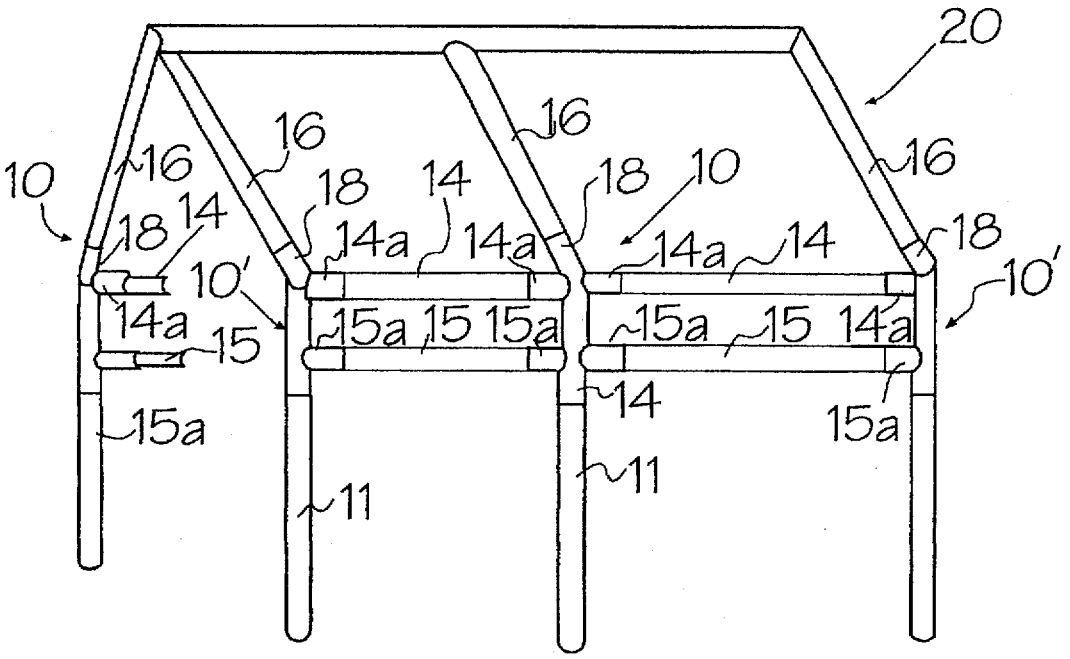
FIG. 2 depicts an in situ, perspective view of the double-tubular joint, shown in FIG. 1, as part of a new tent-frame that is made possible by the double-tubular joint.

Referring to FIGS. 1 and 2, the respective mid-portion and end-portion, double-tubular joints 10 and 10' of this invention are illustrated. The double-tubular joints 10 and 10' allow for the attachment of a vertical support tube 11 (at its lower support end 12), as shown in FIG. 2, and respective first and second horizontal support tubes 14 and 15 at their side support ends 14*a* and 15*b*, respectively. Roof cover support tubes 16 are attached to the double-tubular joints 10 and 10' at their upper support end 18. The end-portion, tubular joints 10' are shown on the left and right sides of the tent-frame 20, in FIG. 2.

Figure 3:
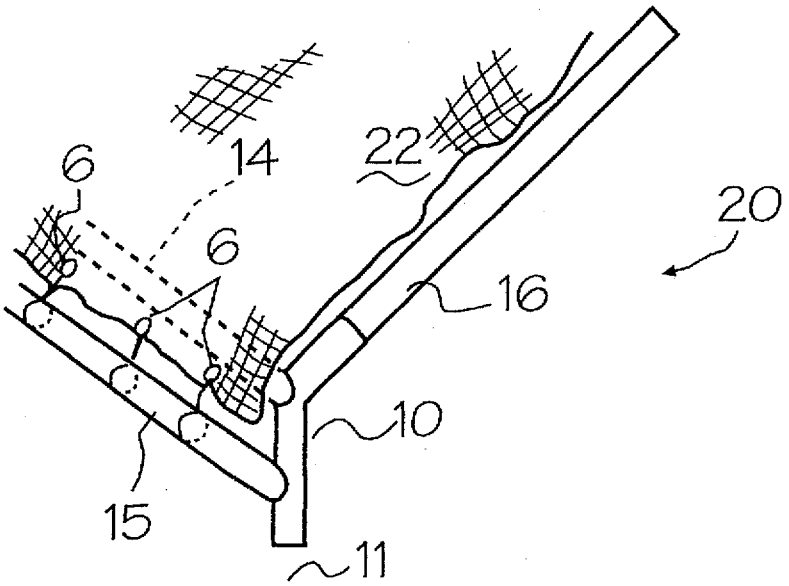
FIG. 3 shows a front, perspective view of a canvas roof cover being attached to the new tent-frame illustrated in FIG. 2.

Referring to FIG. 3, a front, perspective view of a canvas roof cover 22, attached to the new tent-frame 20 illustrated in FIG. 2, depicts the roof cover 22 extending over the horizontal support tube 14 of the roof frame 20, and being secured to the lower horizontal support tube 15. The end-portion, double-tubular joint support 10' is holding horizontal tubes 14 and 15, vertical tube 11 and roof support tube 16.

Figure 4:
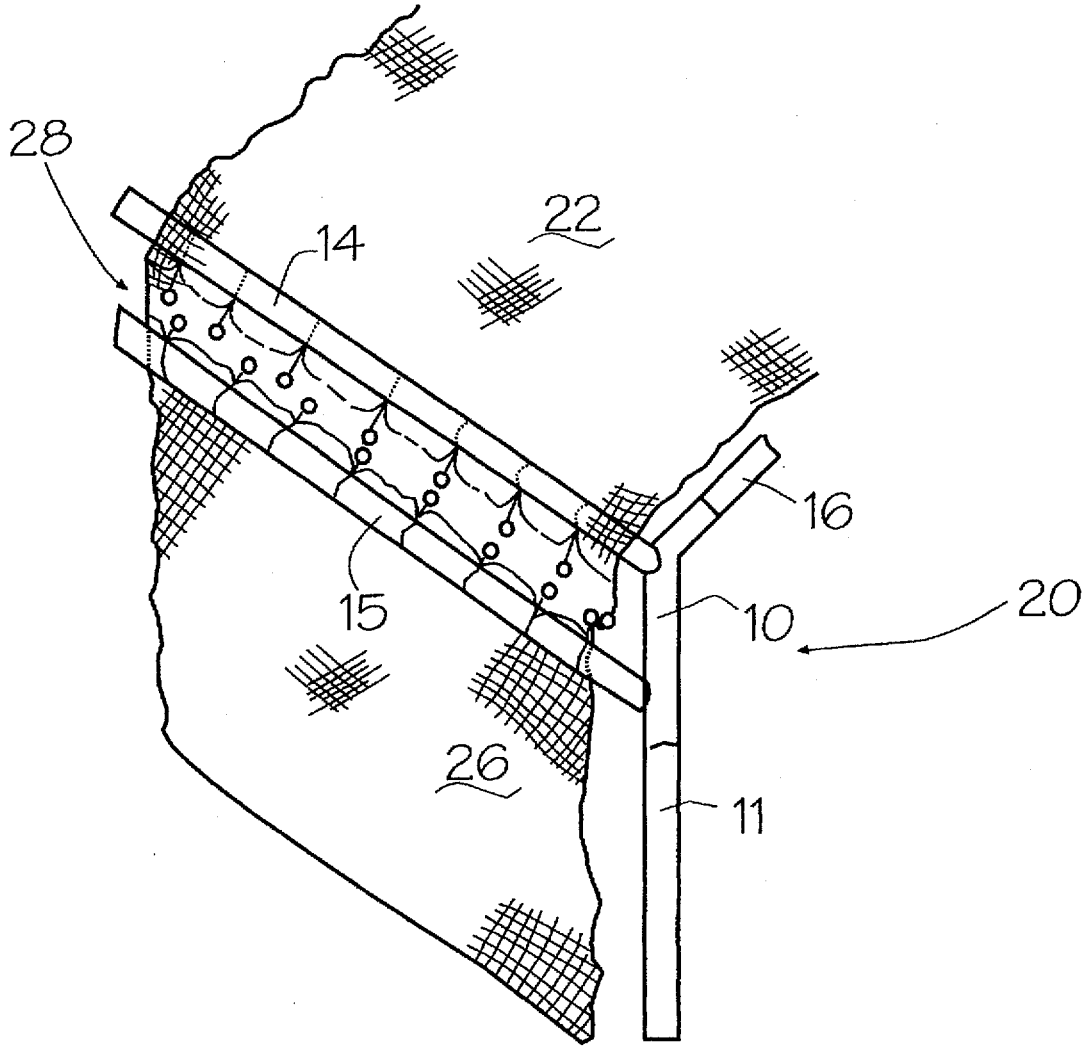
FIG. 4 depicts a side, perspective view of the attachment of one of the side covers of the new tent-frame shown in FIG. 3.

FIG. 4 depicts a side, perspective view of the attachment of one of the side covers 26 to the new tent-frame 20 shown in FIGS. 2 and 3. The side cover 26 can be attached to the frame 20 by extending it up the frame 20 from the inside. The cover 26 is disposed under horizontal support tube 15 and attached to horizontal support tube 14. The roof cover 22 extends over the upper horizontal support tube 14 (shown in phantom) and attaches to the lower support tube 15. The roof cover 22 overlaps with the side cover 26 in the area 28 between the two respective horizontal tubular support tubes 14 and 15. This overlap provides an effective seal against weather.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A, frame support supporting a tent having a roof cover and side covers, said frame support comprising a double-joint supporting a roof support member, a vertical side support member and two, spaced-apart, horizontal supports for allowing said roof cover to overlap with said side covers, thus providing an effective seal against the weather, and wherein said two, spaced-apart, horizontal supports comprise a first, upper, horizontal support member and a second, lower, horizontal support member.

2. The frame support in accordance with claim 1, wherein said first, upper, horizontal support member is substantially parallel to said second, lower, horizontal support member.

3. The frame support in accordance with claim 1, wherein said roof cover is attachable to said second, lower, horizontal support member.

4. The frame support in accordance with claim 1, wherein said side covers are attachable to said first, upper, horizontal support member, and are disposed within said frame inside the second, lower, horizontal support member.

5. A tubular, frame support for supporting a tent having a roof cover and side covers, said tubular, frame support comprising a plurality of double-tubular joints disposed about said tubular, frame support, each of said double-tubular joints supporting a roof support tube, a vertical side support tube and two, spaced-apart, horizontal support tubes for allowing said roof cover to overlap with said side covers, thus providing an effective seal against the weather, and wherein said two, spaced-apart, horizontal support tubes comprise a first, upper, horizontal support tube and a second, lower, horizontal support tube.

6. The tubular, frame support in accordance with claim 5, wherein said first, upper, horizontal support tube is substantially parallel to said second, lower, horizontal support tube.

7. The tubular, frame support in accordance with claim 5, wherein said roof cover is attachable to said second, lower, horizontal support tube.

8. The tubular, frame support in accordance with claim 5, wherein said side covers are attachable to said first, upper, horizontal support tube, and are disposed within said tent's tubular frame inside the second, lower, horizontal support tube.

* * * * *